US005505534A

United States Patent [19]

Laenn et al.

[11] Patent Number: 5,505,534

[45] Date of Patent: Apr. 9, 1996

[54] WIRE DRAWER

[76] Inventors: Per T. Laenn, Ovre Rishalla 4, N-7700 Steinkjer; Sven O. Haugen, Nordskaget, N-7650 Verdal, both of Norway

[21] Appl. No.: 256,522

[22] PCT Filed: Jan. 6, 1993

[86] PCT No.: PCT/NO93/00003

§ 371 Date: Sep. 27, 1994

§ 102(e) Date: Sep. 27, 1994

[87] PCT Pub. No.: WO93/13694

PCT Pub. Date: Apr. 22, 1993

[30] Foreign Application Priority Data

Jan. 9, 1992 [NO] Norway ..... 920112

[51] Int. Cl.[6] ..... A47B 88/00

[52] U.S. Cl. ..... 312/334.21; 312/330.1

[58] Field of Search ..... 312/334.21, 311, 312/330.1, 334.18; 211/181

[56] References Cited

U.S. PATENT DOCUMENTS

| | | | |
|---|---|---|---|
| 362,207 | 5/1887 | Dechent | 312/334.21 X |
| 2,510,453 | 6/1950 | Yoars | 211/181 |
| 2,721,780 | 10/1955 | Peterson et al. | 312/311 X |
| 3,095,250 | 6/1963 | Frederick | 312/334.21 |
| 3,214,227 | 10/1965 | Filipowicz | 312/334.21 X |
| 4,193,649 | 3/1980 | Sharon | 312/334.21 X |
| 4,449,765 | 5/1984 | Lampman | 312/311 |
| 5,209,555 | 5/1993 | Camilleri | 312/311 X |

FOREIGN PATENT DOCUMENTS

| | | | |
|---|---|---|---|
| 33428 | 2/1964 | Finland | 312/334.21 |
| 665107 | 4/1988 | Switzerland | 312/330.1 |

*Primary Examiner*—Peter M. Cuomo
*Assistant Examiner*—Janet M. Wilkins
*Attorney, Agent, or Firm*—Chilton, Alix & Van Kirk

[57] ABSTRACT

A wire drawer with a ribbon shaped upper rim. A guide roller is attached to the rim at each of two adjacent corners. To carry this roller, the rim is bent down at the corner to make a lug which is perpendicular to the plane of the rim. The axle of the roller is attached in a central area of this lug to hold the roller within the outer edge of the rim, but extending above its upper level.

4 Claims, 2 Drawing Sheets

WIRE DRAWER

BACKGROUND OF THE INVENTION

The invention relates to wire drawers for use in a cabinet or similar structure. More particularly, the present inventionrelates to wire drawers for wardrobe cabinets.

Wire baskets carried in slides attached in cabinets, in carrying frames and similar structures are commonly used as drawers.

It is previously known to attach a pair of slides, each with a guiding roller, at opposite edges of a frame made of steel ribbon. This design requires a relatively high mass of additional material resulting in an increase in height which in some cases is unsuitable and undesirable.

This design requires additional equipment and additional manufacturing steps. Thus, it is desirable to have a wire basket which is more economic to produce.

SUMMARY OF THE INVENTION

The main object of the present invention is to provide a wire drawer which is less expensive to manufacture than prior an drawers. It is a particular object to provide a wire drawer having fewer parts and which can be manufactured with fewer manufacturing steps than prior art wire drawers with guiding rollers.

These objects are achieved in accordance with the present invention, by a wire basket comprising an upper rectangular rim or flange. The rim is bent down at two adjacent corners to create lugs which are perpendicular to the plane of the rim. Guide rollers mounted on the two lugs are supported on guide rails or similar structure which are carried by the cabinet. This wire drawer reduces the material consumption to a minimum, while the manufacturing operations to mount the guiding rollers are simple and can be robotized.

Other objects and advantages of the invention will become apparent from the drawings and specification.

BRIEF DESCRIPTION OF THE DRAWING

The invention is further described with reference to the drawings illustrating an embodiment, wherein.

DETAILED DESCRIPTION OF THE PREFERRED EMBODIMENT

Figure 1:
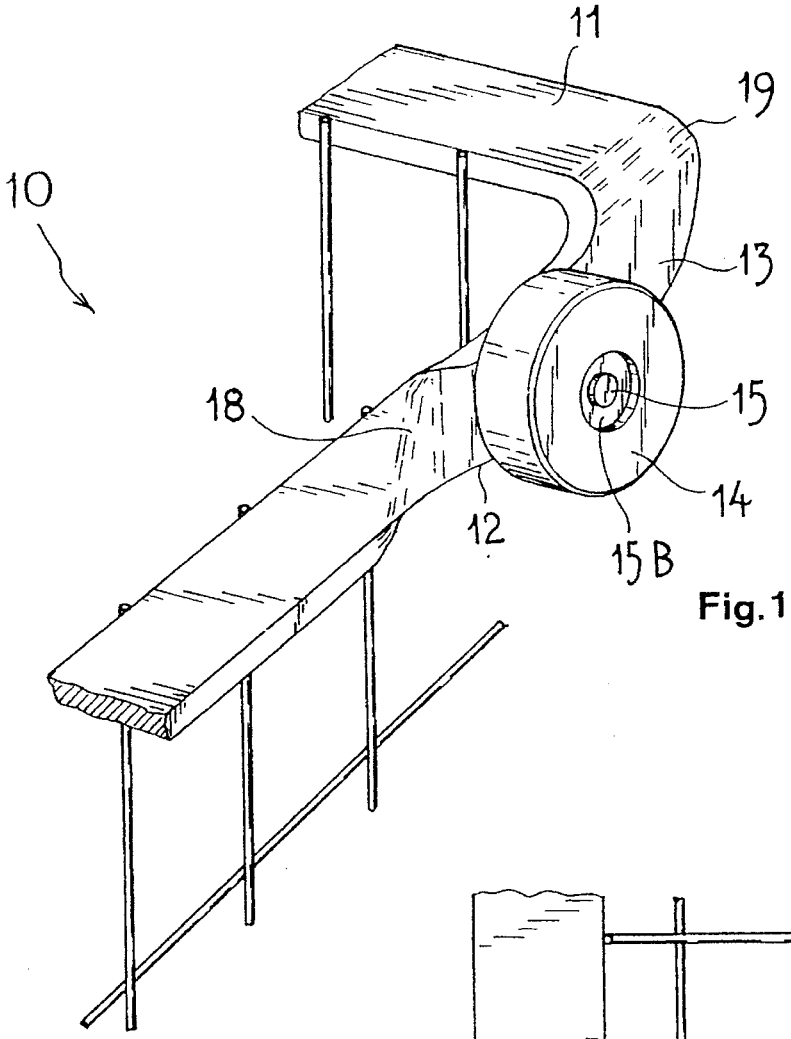
FIG. 1 shows a perspective view of a corner of a wire drawer.
Figure 2:
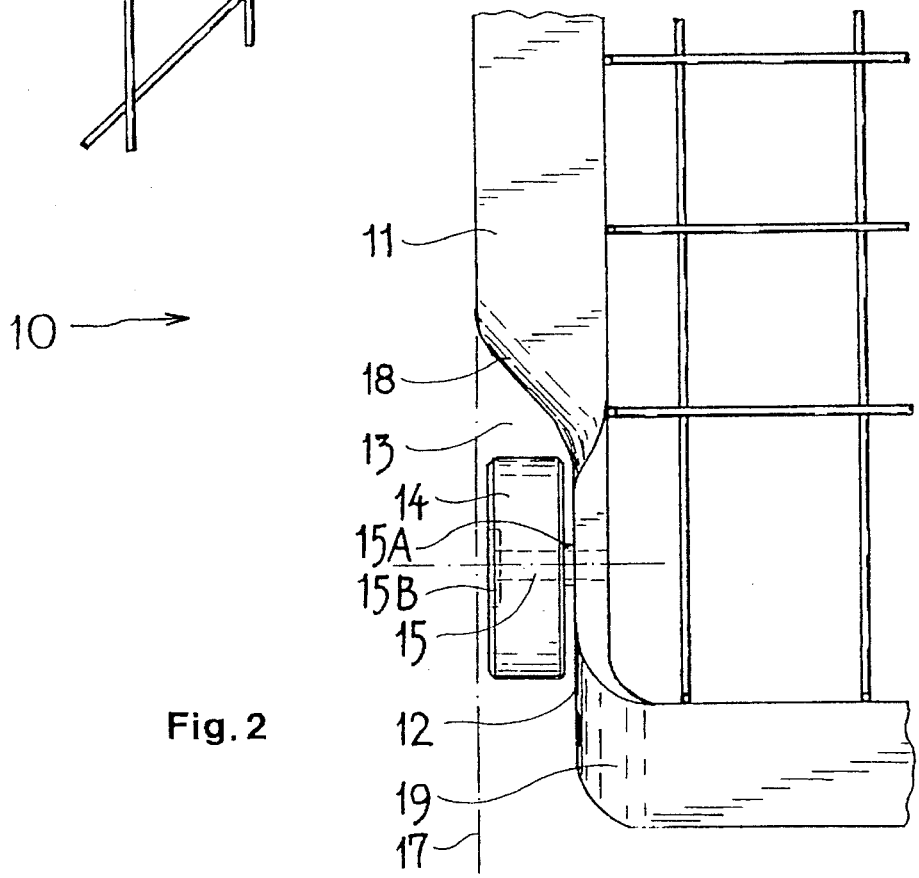
FIG. 2 shows the comer of FIG. 1 in a plane view from above.
Figure 3:
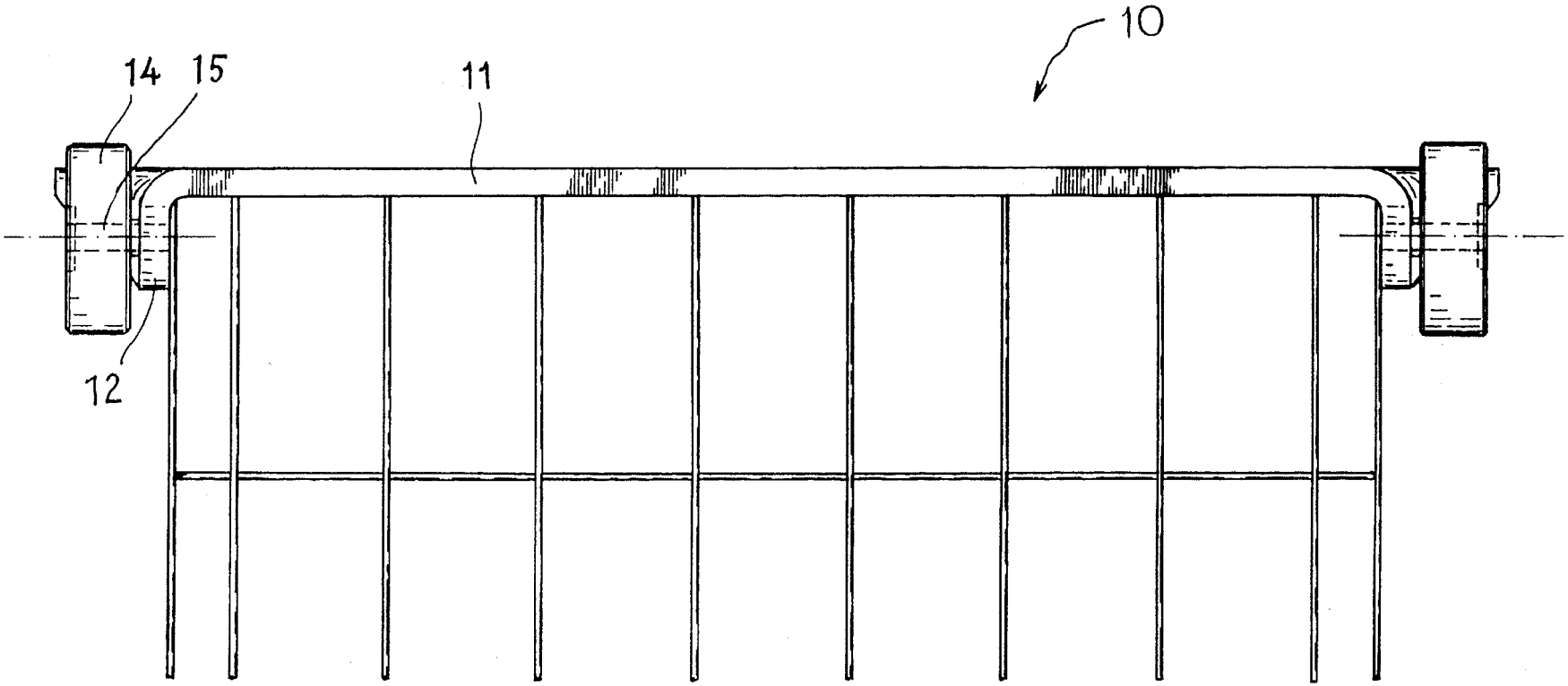
FIG. 3 shows a perspective view of two corners of the wire drawer.

With reference to the drawing wherein like numerals represent like parts throughout the several figures, a wire basket in accordance with the present invention is generally designated by the number 10. The wire drawer 10 comprises a rectangular frame 11 of steel ribbon defining a frame plane, the ends being joined by welding. At two adjacent corners the frame is bent downward, making two mutually parallel lugs 12 which extend down from the plane of the frame with the inner sides adjacent the inner edge of the frame. This creates a notch at the edge of the frame as shown at 13 in FIG. 2.

The lugs 12 are bent downwardly with one edge 18 arranged to be further distant from the corner than the other 19. A guiding roller 14, pivotably journalled on an axle 15 is arranged in the notch. The axle 15 is received in a bore in the lug 12 and is riveted thereto. The axle 15 is arranged centrally on the lug, making the guiding roller extend above the frame 11 and under the lug 12. The axle 15 may be pressed or cut with flanges 15A and provided with a washer 15B at the free end thereof.

This allows the of the attachment of the guiding roller 14 with no additional elements and with easy assembly operations.

Additionally, the guiding rollers 14 will be advantageously arranged at the corner of the wire drawer 10, without protruding excessively outside the drawer in any direction. This provides stacking and transport advantages.

The invention can also be utilized for drawers of materials other than wire. It can be used for drawers of metal and plastic in combination, with an upper rim or a flange.

The invention allows the guiding rollers at the front of the cabinet or carrying structure to roll directly against the frame 11.

While preferred embodiments have been shown and described, various modifications and substitutions may be made thereto without departing from the spirit and scope of the invention. Accordingly, it is to be understood that the present invention has been described by way of illustration and not limitation.

We claim:

1. An improved basket intended for use as a drawer in a cabinet or similar structure, the basket having an upper rectangular rim or flange of ribbon material on a meshed wire or sheet structure, the rim defining a plane, the basket further having guide rollers mounted on two adjacent corners of the basket, each of the rollers being mounted on an axle, the improvement comprising that the rim at each of the adjacent corners is bent down to define a lug, said lugs being generally perpendicular to the rim plane, the axle of each guide roller being attached centrally on a said lug wherein the guide rollers protrude over the rim.

2. The basket of claim 1 wherein each of said lugs is bent downward, defining first and second bending edges, said bending edges each being at a distance from a corner wherein said first bending edge is at a greater distance than said second bending edge.

3. The basket of claim 1 wherein each of said lugs is bent downward wherein each of said lugs are adjacent an inner side of the rim.

4. The basket of claim 1 wherein each of the axles has an axis, each of said axes being located at a level below a lower side of the rim.

* * * * *